US005360434A

United States Patent [19]

Mann

[11] Patent Number: 5,360,434

[45] Date of Patent: Nov. 1, 1994

[54] NON-REMOVABLE EARRING AND CLUTCH EAR PIERCING INSTRUMENT

[75] Inventor: Samuel J. Mann, Fair Lawn, N.J.

[73] Assignee: Inverness Corporation, Fair Lawn, N.J.

[21] Appl. No.: 936,936

[22] Filed: Aug. 28, 1992

[51] Int. Cl.[5] ..... A61B 17/34

[52] U.S. Cl. ..... 606/188

[58] Field of Search ..... 606/188, 117

[56] References Cited

U.S. PATENT DOCUMENTS

| | | | |
|---|---|---|---|
| 4,030,507 | 6/1977 | Mann | 606/188 |
| 4,943,294 | 7/1990 | Knapp | 606/188 |
| 5,004,470 | 4/1991 | Mann | 606/188 |
| 5,007,918 | 4/1991 | Mann | 606/188 |

FOREIGN PATENT DOCUMENTS

| | | | |
|---|---|---|---|
| 2023510 | 1/1980 | United Kingdom | 606/117 |
| 2142538 | 1/1985 | United Kingdom | 606/188 |

*Primary Examiner*—Tamara L. Graysay

*Attorney, Agent, or Firm*—Stroock & Stroock & Lavan

[57] ABSTRACT

An ear piercing assembly includes a first and second earring stud and a stud retaining sub-assembly for releaseably supporting the studs therein. A clutch retaining sub-assembly releaseably supports a first and second clutch therein. A push rod is mounted along with the stud retaining sub-assembly and clutch retaining sub-assembly on a housing. A keeper is provided for selectively moving the push rod between a first position for ejecting the first stud from the stud retaining sub-assembly and a second position for ejecting the second stud from the stud retaining sub-assembly.

19 Claims, 6 Drawing Sheets

FIG. 4
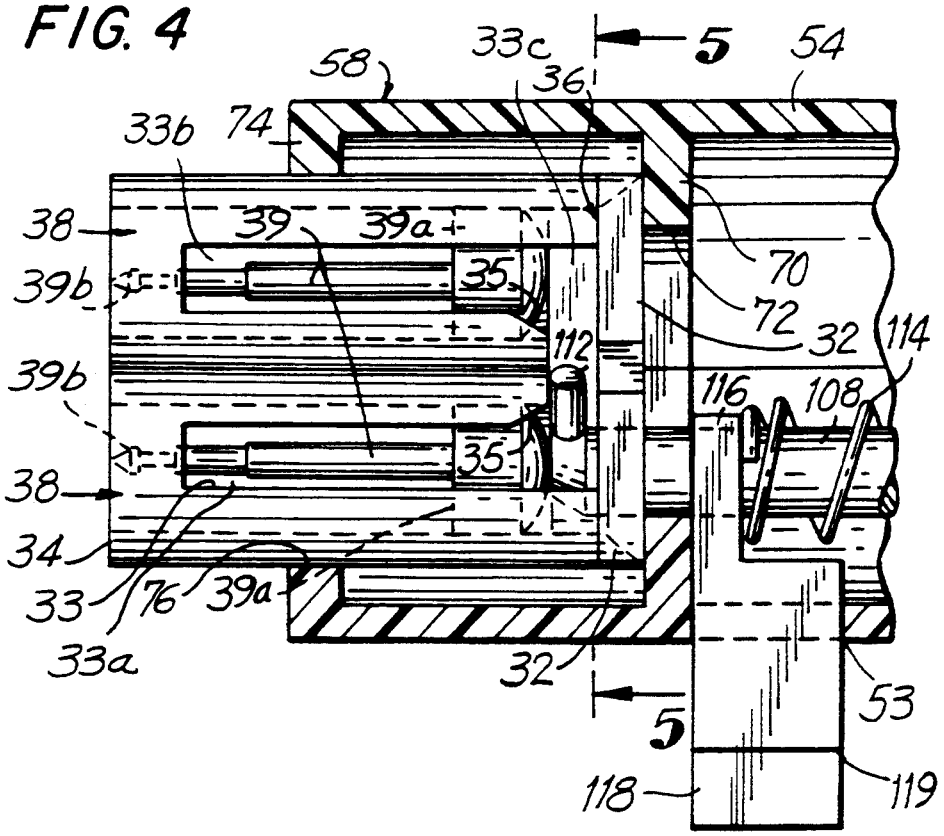
FIG. 5
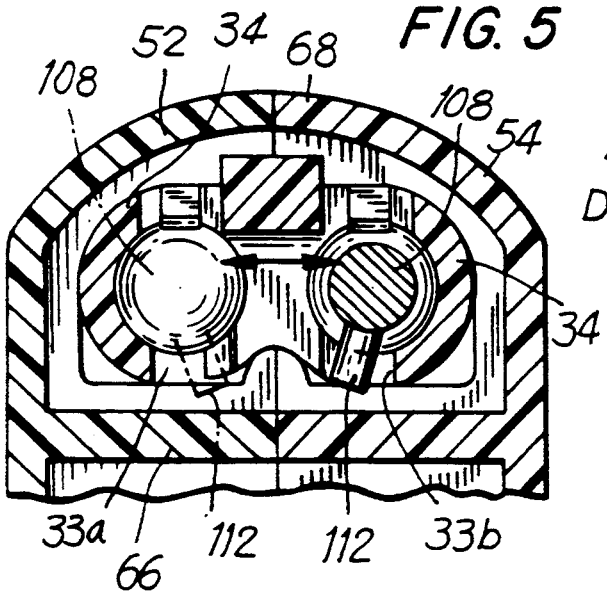
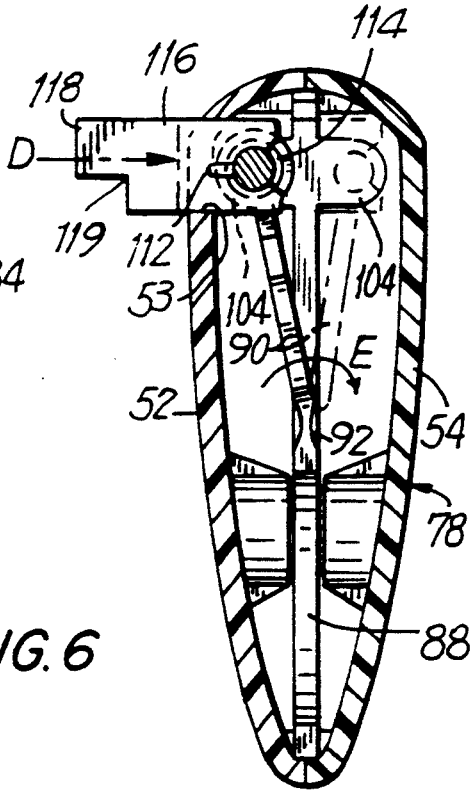
FIG. 6

122
39a
39b
41
49
43
47
51a
44
42
51b
46
40
56
62
64
60
58
68
74
76
34
38
37a
31
33
32
72
116
114
108
70
66
36
112

NON-REMOVABLE EARRING AND CLUTCH EAR PIERCING INSTRUMENT

BACKGROUND OF THE INVENTION

This invention is directed to an ear piercing assembly, and in particular, to a disposable ear piercing instrument having a displaceable push rod.

Ear piercing systems are well known in the art. Present ear piercing systems are particularly characterized by an earring stud with a sharpened point being inserted through the ear lobe by a spring loaded instrument or assembly. However, during insertion of the earring stud into the earlobe during piercing, there may be a splattering of blood onto the instrument or earring cartridge. Additionally, the ear often comes in contact with the ear piercing instrument or cartridge with the potential for passing communicable diseases between consecutive ears in that manner. Accordingly, with the advent of highly contagious and infectious diseases such as AIDS, the prevention of cross-contamination between subsequent users of such instruments has become a concern in the ear piercing industry.

To improve sterility and safety and prevent cross-contamination from ear to ear of subsequent patients or consumers having their ears pierced, disposable ear piercing instruments have been developed. These ear piercing instruments have been less than completely satisfactory because they do not provide sufficient sterility.

The deficiencies with previous disposable ear piercing instruments are two fold. First, most disposable ear piercing instruments on the market require earrings or earring retaining cartridges which require manipulation between positions during the ear piercing process. This results in excessive touching and handling of the earrings and cartridges. With increased handling, one becomes concerned with the cleanliness of the operator and the potential for dropping the earrings. Each of these occurrences contribute to contamination of the earrings or the operator of the ear piercing instrument or potential misuse of the cartridges.

The other problem which occurs in known prior art is found in instruments that solve the sterility problem by containing the earrings and clasps within tiny pincer type holders. However, these pincer type holders are awkward to manipulate and therefore provide a high potential for misuse and are potentially unsafe. Accordingly, a disposable ear piercing instrument which eliminates earring handling through a simple unitary construction and overcomes the shortcomings of the prior art is desired.

SUMMARY OF THE INVENTION

Generally speaking, in accordance with the instant invention, a disposable ear piercing assembly is provided. A housing is formed with an anvil thereon to define a saddle region for receiving an earlobe between the anvil and the remainder of the housing. A clutch retaining sub-assembly containing two clutches in side-by-side relationship is secured within the anvil. A stud retaining sub-assembly contains two studs to cooperate with an associated clutch and is mounted on the housing across the saddle region from the clutch retaining sub-assembly. A push rod assembly is mounted within the housing and is selectively capable of driving either the first or second stud from the stud retaining sub-assembly to engage the associated clutch.

In one embodiment of the invention, the stud retaining sub-assembly is slidably mounted within the housing so that the stud retaining sub-assembly is moved towards the clutch retaining sub-assembly prior to the ejection of the stud from the stud retaining sub-assembly. The push rod assembly is formed with a retraction hook for returning the stud retaining sub-assembly to the starting position. The housing is also formed with a hole therein for receiving the fingers of the user to aid in balancing, positioning and aiming the ear piercing instrument during use.

Accordingly, it is an object of the present invention to provide an improved ear piercing instrument.

Another object of the instant invention is to provide a disposable ear piercing instrument system wherein at least two stud earrings and two clutches are positioned within the instrument and require no handling of the earring or clutches to perform ear piercing.

A further object of the invention is to provide a safe and disposable ear piercing instrument having a simple and inexpensive construction.

Yet another object of the present invention is to provide an improved ear piercing instrument which reduces the amount of handling of the stud, clutch and or instrument.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention reference is had to the following description taken in connection with the accompanying drawings in which:

FIG. 4 is a sectional view taken along line 4—4 of FIG. 3;

FIG. 5 is a sectional view taken along line 5—5 of FIG. 4;

FIG. 6 is a sectional view taken along line 6—6 of FIG. 3;

DETAILED DESCRIPTION OF THE PREFERRED EMBODIMENT

Figure 1:
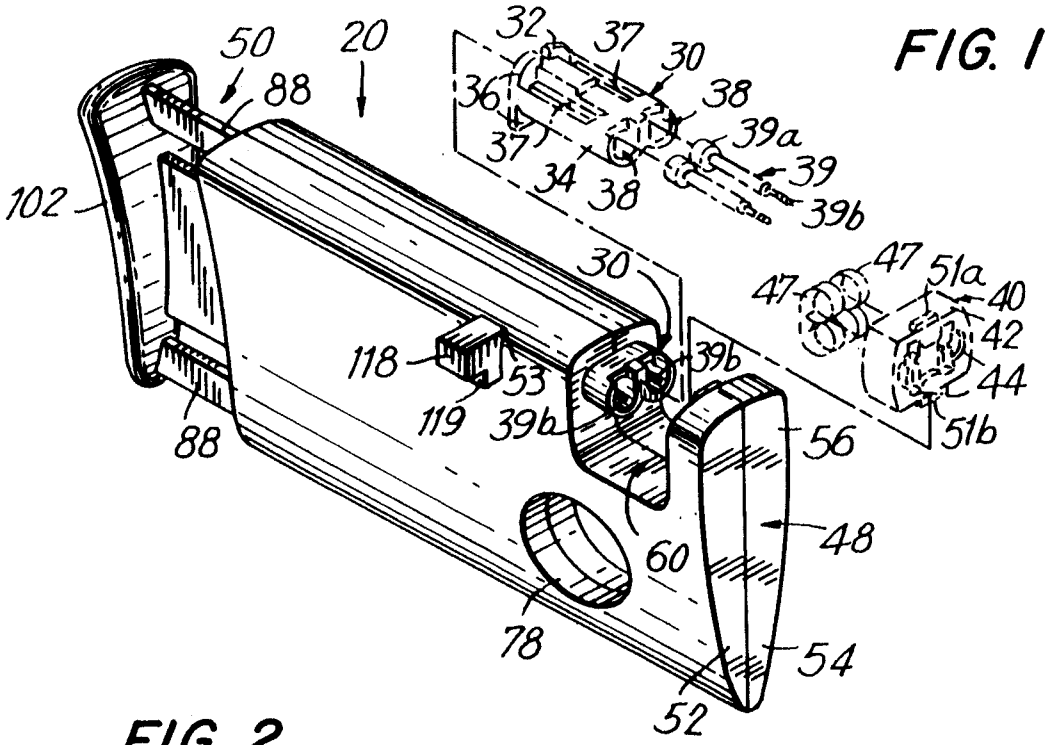
FIG. 1 is a perspective view of the ear piercing assembly constructed in accordance with the invention with the stud retaining sub-assembly and clutch retaining sub-assembly shown in phantom as exploded.

Reference is now had to FIGS. 1–4 and 7 wherein an ear piercing assembly, constructed in accordance with a preferred embodiment of the instant invention, and generally indicated as 20, is depicted. Ear piercing assembly 20 includes a stud retaining sub-assembly generally indicated as 30, a clutch retaining sub-assembly generally indicated as 40, and a push rod assembly generally indicated as 50. Push rod assembly 50, clutch retaining sub-assembly 40 and stud retaining sub-assembly 30 are all supported within a housing 48.

Figure 3:
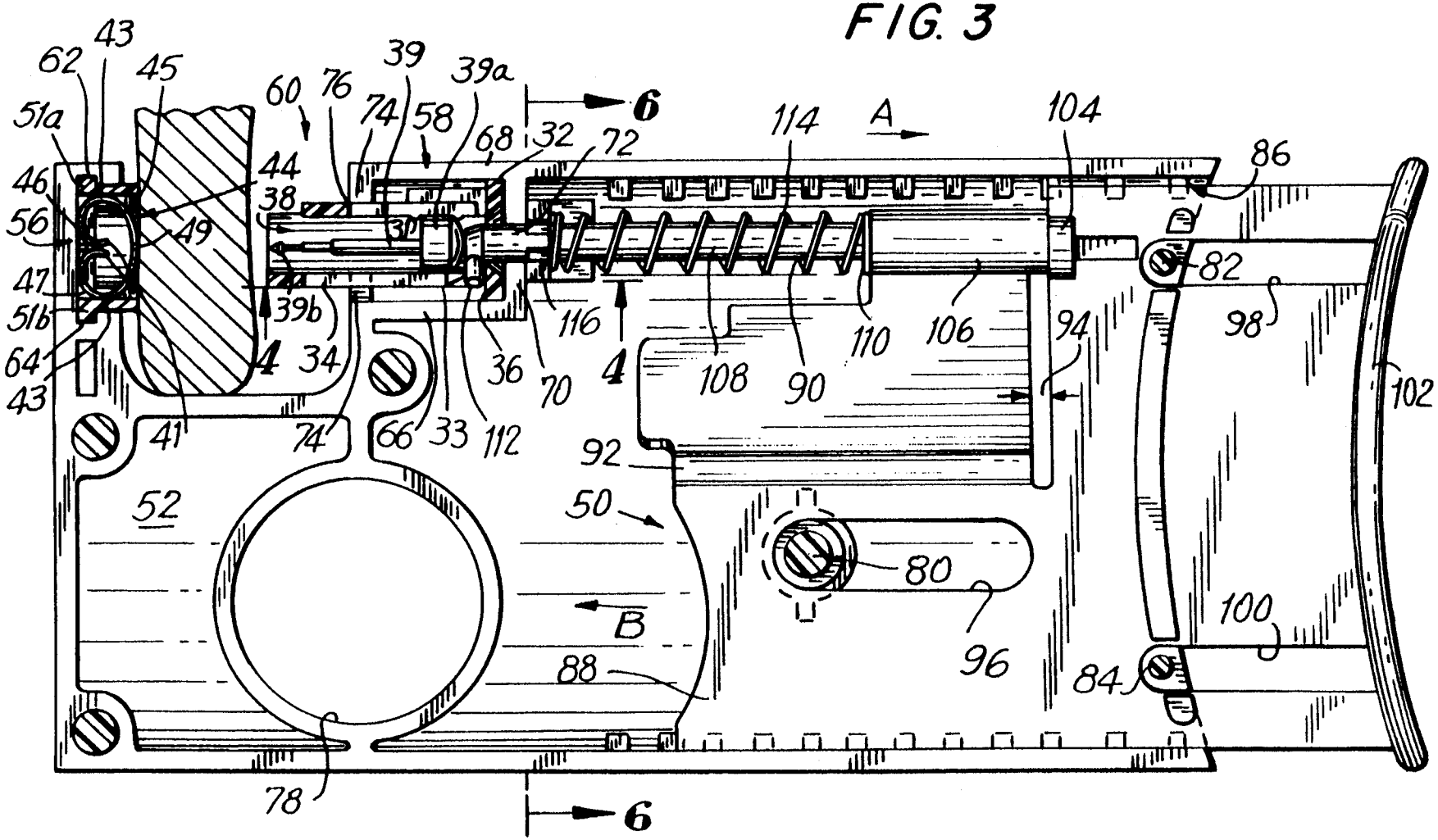
FIG. 3 is a sectional view taken along line 3—3 of FIG. 2.
Figure 7:
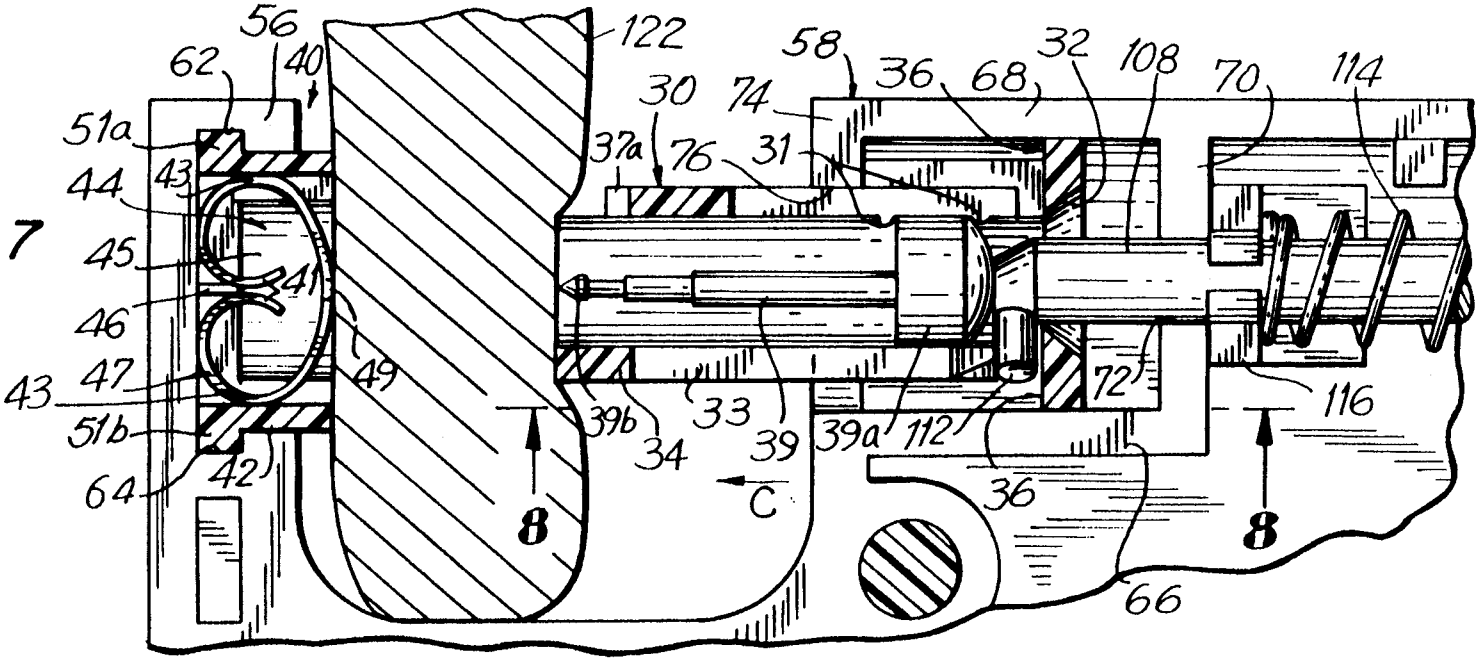
FIG. 7 is a partial sectional view of the saddle region of the ear piercing assembly constructed in accordance with the invention during piercing.
Figure 8:
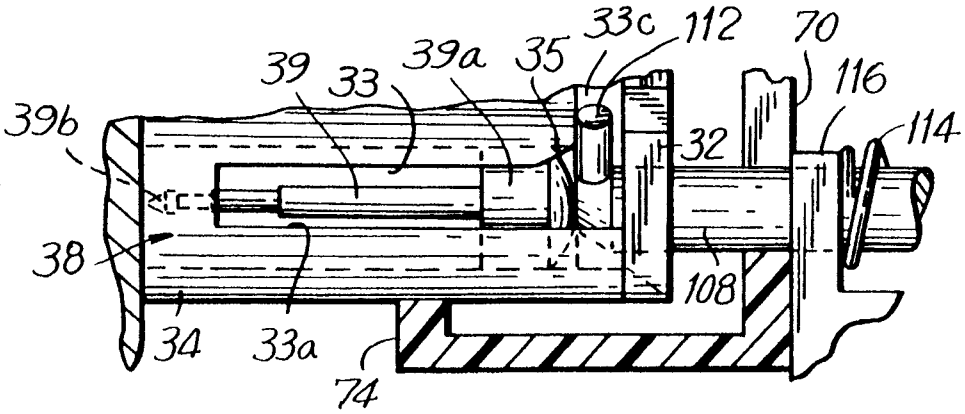
FIG. 8 is a sectional view taken along line 8—8 of FIG. 7.
Figure 9:
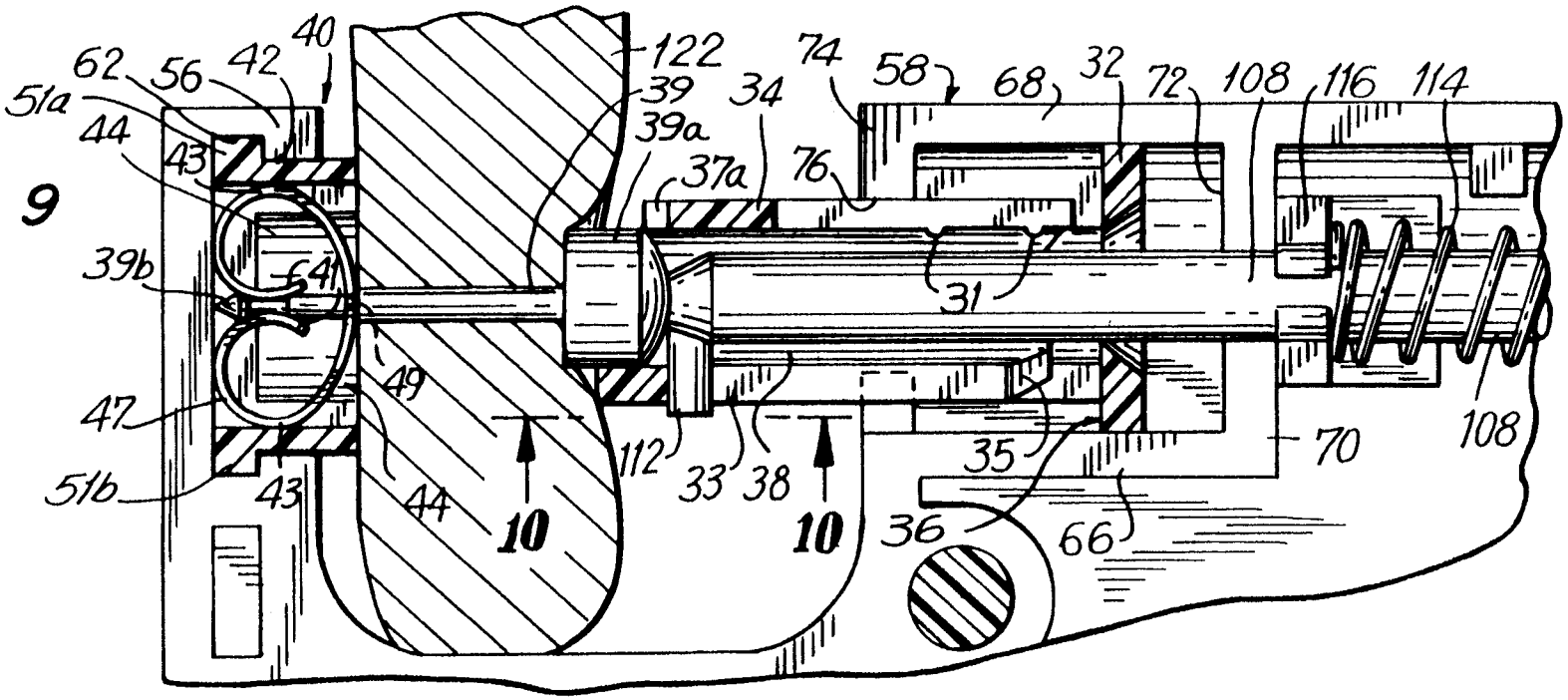
FIG. 9 is a sectional view of the saddle region of the ear piercing device at the completion of piercing.
Figure 10:
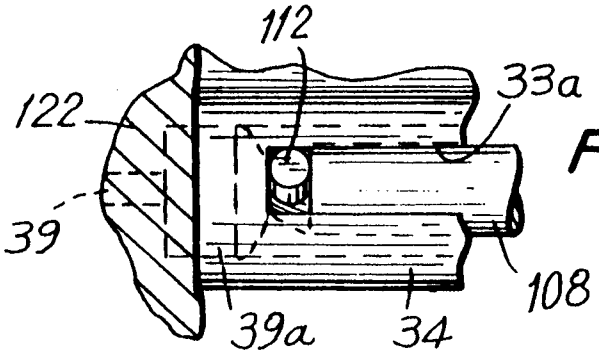
FIG. 10 is a sectional view taken along line 10—10 of FIG. 9.
Figures 11, 12:
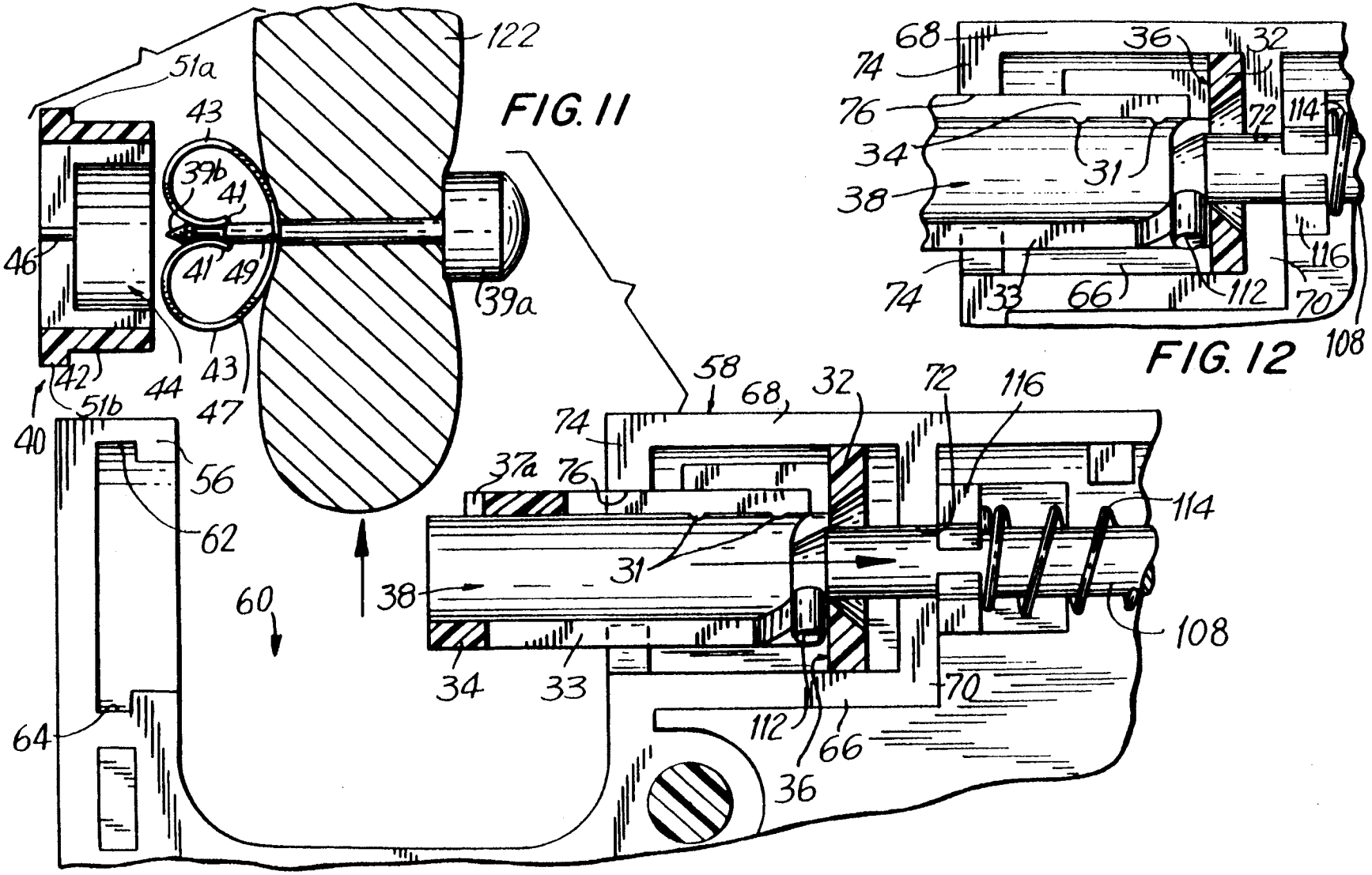
FIG. 11 is a sectional exploded view of the saddle region of the ear piercing assembly constructed in accordance with the invention after piercing has occurred.
FIG. 12 is a sectional view of the stud retaining subassembly after piercing has occurred.

Referring to FIGS. 1, 3 and 4 stud retaining sub-assembly 30 includes a rear support wall 32 and a casing 34 extending from support wall 32. Support wall 32 extends beyond casing 34 to define flanges 36. Two bores 38 axially extend for the length of casing 34 and through support wall 32. Bore 38 receives a stud 39 having a head 39*a* and a piercing pin 39*b* on axis. The diameter of each bore 38 is dimensioned with respect to the size of each stud 39 to snugly retain studs therein by an interference fit. Studs 39 are further retained within stud retaining sub-assembly 30 by ribs 31 formed within bore 38. In an exemplary embodiment windows 37 are formed parallel with each bore 38 and are axially aligned with the piercing pin 39*b* to facilitate aiming the piercing earring at the ear lobe. As seen in FIG. 4, a U-shaped groove 33 is formed in the bottom surface of casing 34 and is formed with a first leg 33*a* and a second leg 33*b* each of which communicates with a base 33*c*. A chamfered corner 35 is formed where each leg 33*a*, 33*b* communicates with base 33*c* forming the continuous U-shaped groove 33.

Reference is now made to FIGS. 1, 2, 7 and 9 wherein a clutch retaining sub-assembly 40, including a clutch housing 42 and clutches 47, is depicted. Each clutch 47 is formed of a single piece of resilient metal having a C-shaped configuration forming two symmetrical loops 43, having ends 41. An opening 49 is provided in the metal for receiving piercing pin 39*b* of an earring and is coaxial with the space between ends 41.

Housing 42 includes a solid molded casing. Casing 42 includes two clutch chambers 44 (shown in FIG. 1) formed by parallel blind holes 45. Blind holes 45 are of sufficient depth to permit the clutch 47 to be recessed from the outer surface of the casing defining housing 42 so that clutch 47 is prevented from accidentally coming into contact with a person's finger. A nib 46 projects from blind hole 45 and is extended to rest between the end 41 and loops 43 of each clutch 47 to place in position and secure clutch 47 in clutch chamber 44. When piercing pin 39*b* enters opening 49 and continues until it is between ends 41 of loop 43, the ends 41 are spread apart and no longer held by nibs 46. Accordingly, each clutch chamber 44 is configured to releaseably secure clutch 47 therein until clutch 47 is secured on a piercing pin 39*b* of an earring after the ear lobe has been pierced. Clutch housing 42 is formed with top flange 51*a* and a bottom flange 51*b*.

Reference is now made to FIGS. 1–6 wherein push rod assembly 50 and housing 48 are depicted. Housing 48 is a two piece frame formed of molded halves 52, 54 which are substantially mirror images of each other with the exception of an opening 53 formed in molded halve 52. Halve 52 is shown and described in detail as representing both halve 52 and halve 53.

Housing 48 defines an anvil 56 and a stud retaining sub-assembly receiving portion 58 which are formed in opposed relationship across a gap forming a saddle region 60. Anvil 56 is formed with a first slot 62 dimensioned to receive and retain flange 51*a* of clutch retaining sub-assembly 40 and a second slot 64 to receive and retain flange 51*b* of clutch retaining sub-assembly 40 maintaining clutch retaining sub-assembly 40 in position during operation.

Stud retaining sub-assembly receiving portion 58 includes a floor 66 and a top 68 separated by a rear wall 70 having an opening 72 formed therein. A front wall 74 extends between floor 66 and top 68 to form a box for containing stud retaining sub-assembly 30 therein. Front wall 74 has an opening 76 formed therein having the same shape as the outline of stud retaining sub-assembly casing 34. Stud retaining sub-assembly receiving portion 58 has a height substantially equal to the height of support wall 32 and has a length less than the length of stud retaining sub-assembly 30 so that a portion of casing 34 always extends through opening 76. Stud retaining sub-assembly 30 is slidably retained within stud retaining sub-assembly 58 and slides between a first position in which support wall 32 is flush against rear wall 70 and a second position in which support wall 32 is flush against front wall 74. Opening 76 is dimensioned so that front wall 74 contacts flanges 36 preventing stud retaining sub-assembly 32 from passing entirely through opening 76.

Housing 48, is formed with a finger opening 78 extending therethrough adapted to receive a finger of the user. A plurality of pins 80, 82 and 84 are mounted within housing 48 and maintain push rod assembly 50 in position as well as guide push rod assembly 50 during movement of push rod assembly 50 as will be discussed in detail below. Housing 48 is formed with a rear opening 86 extending substantially the entire height of housing 48. A portion of push rod assembly 50 extends through opening 86 allowing operation of push rod assembly 50. For simplicity of construction, pins 80, 82, and 84 may be screws or the like for affixing housing portion 52 to housing portion 54.

Push rod assembly 50 includes a base 88 having a substantially L-shape. A push rod 90 is mounted on base 88 through a pivotable hinge 92. A gap 94 extending between base 88 and push rod 90 allowing movement of push rod 90 relative to base 88 about pivotable hinge 92. By way of example, hinge 92 may be a living hinge. Base 88 is provided with a plurality of substantially parallel grooves 96, 98 and 100 formed therein which are dimensioned to receive pins 80, 82 and 84 respectively so that base 88 is slidably disposed within housing 48. Pins 80, 82 and 84 also aid in guiding base 88 as it moves within housing 48 while the end of each respective groove 96, 98 and 100 prevents base 88 from moving too far in either direction.

Base 88 is formed with a convexly shaped shoulder 102. Shoulder 102 is convex to fit snugly between the index finger and thumb of a variety of users having different sized hands. Ears 104 are formed on base 88 behind push rod 90 and are substantially coaxial with bores 38. Push rod 90 is formed with a rear portion 106 and an engaging portion 108. Engaging portion 108 has a diameter smaller than rear portion 106 and a shoulder 110 is formed therebetween.

Rear portion 106 extends across gap 94 and slidably contacts ears 104. Engaging portion 108 extends through opening 72 of rear wall 70 of stud retaining sub-assembly receiving portion 48 and into bore 38 of stud retaining sub-assembly 30. Engaging portion 108 slides within opening 72 as push rod 90 pivots about living hinge 92 to be selectively coaxial with each bore 38. A hook 112 is formed on engaging portion 108 and is disposed within a U-shaped groove 33. A keeper 116 encircles a portion of engaging portion 108 adjacent rear wall 70 and extends through opening 53 forming a button 118 outside of housing 48. Button 118 is formed with a notch 119 therein. Engaging portion 108 is slidably disposed within keeper 116 so that keeper 116 does not interfere with the forward motion of push rod 90. A spring 114 is disposed between shoulder 110 and keeper 116 for biasing push rod 90 and in turn base 88 therewith in the direction of arrow A (FIG. 3).

By utilizing a convex shaped shoulder 102 in cooperation with finger opening 78 adjacent the anvil, as the user squeezes an ear piercing assembly to push push rod assembly 50, ear piercing assembly 20 is anchored within the palm of the hand of the user between the finger extending within finger opening 78 and the web between the index finger and the thumb. Accordingly, the instrument will be as steady as the hand of the user and the user may utilize the extended index finger of the piercing hand as one further aiming device much as one would aim a gun. Further, by utilizing a finger which is opposed to the thumb as anchorage in finger opening 78, adequate leverage is now provided for the force required to actuate push rod assembly 50.

In operation, an ear piercing assembly 20 is assembled by molding stud retaining sub-assembly 30, clutch retaining sub-assembly 40, push rod assembly 50 and housing 48 as individual components. The components are then assembled into the single unit described above. The assembled ear piercing assembly 20 is then sterilized, packaged and shipped to the end user.

In the shipped state, button 118 formed by keeper 116 extends out of housing 48 through opening 53. Rear portion 106 is in contact with an ear 104 closest to housing valve 52. Hook 112 engages support wall 32 so that when spring 114 biases push rod 90 in the direction of arrow A, hook 112 acts as a retraction means on support wall 32 maintaining support wall 32 flush against rear wall 72 of retaining sub-assembly receiving portion 58. As a result stud retaining sub-assembly 30 is substantially retracted within stud retaining sub-assembly receiving portion 58. At the same time, base 88 extends out from opening 86 of housing 48.

Figure 2:
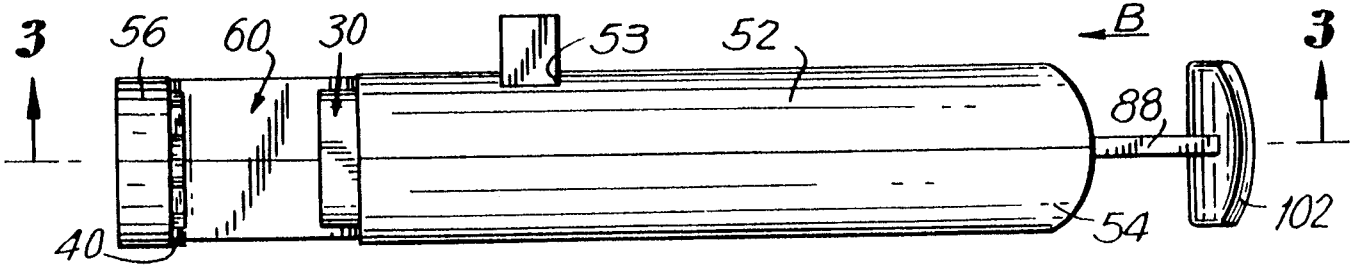
FIG. 2 is a top plan view of the ear piercing assembly constructed in accordance with the invention.

The user unwraps ear piercing assembly 20 and positions housing 48 relative to an ear lobe 122 so that ear lobe 122 is disposed within saddle region 60 (FIG. 3). Convex shoulder 102 is placed between the forefinger and thumb of the user and the index finger or the middle finger of the user is positioned through hole 78 to steady ear piercing assembly 20 during use. By squeezing convex shoulder 102 towards housing 48, ears 104 drives rear engaging portion 108 and in turn push rod 90 in the direction of arrow B (FIGS. 2, 3). Push rod assembly 50 is moved in the direction of arrow B so that push rod engaging portion 108 pushes against stud 39. Because stud 39 is maintained in place within stud retaining sub-assembly 30 by rib 31, engaging portion 108 pushing on stud 39 moves stud 39 which carries with it the entire stud retaining sub-assembly 30 in the direction of arrow C (FIG. 7) so that flange 36 moves toward front wall 74. Ear lobe 122 is pinched and positioned between clutch retaining sub-assembly 40 and stud retaining sub-assembly 30.

The instrument operator may use stud pins **39*b* as viewed through opening 37*a* to ensure proper alignment between stud 39 and the piercing target. Because stud retaining sub-assembly 30 is blocked against ear lobe 122, continued pushing on push rod assembly 50 causes engagement portion 108 of push rod 90 to push stud 39 through bore 38 deflecting rib 31. Hook 112 travels along leg 33*a* of U-shaped groove 33 so that there is no interference when engaging portion 108 travels through bore 38. Engaging portion 108 drives stud 39 through ear lobe 122 (FIG. 9) so that clutch ends 41 engage stud pin 39*b* lifting clutch 47 from nib 46**.

Push rod assembly 50 is released so that bias spring 114 moves push rod assembly 50 in the direction of arrow A (FIG. 3). This causes engaging portion 108 to move in the direction of arrow A through bore 38. Hook 112 of engaging portion 108 comes in contact with support wall 32 so that as engaging portion 108 travels in the direction of arrow A hook 112 carries support wall 32 and stud retaining sub-assembly casing 34 with it returning stud retaining sub-assembly 32 to the starting position, flush against rear wall 70. This separates stud retaining sub-assembly 30 from the ear allowing ear lobe 122 to be removed from saddle area 60.

At this step during operation, conventional ear piercing instruments require either movement of the retaining sub-assemblies into a firing position or replacement of the retaining sub-assembly which is now empty with a second retaining sub-assembly to pierce either the same ear lobe again or opposite ear.

This type of physical bondage is avoided in the instant invention. Specifically, button 118 of keeper 116 is pushed in the direction of arrow D (FIG. 6) causing push rod 90 to rotate about pivotal hinge 92 in the direction of arrow E (FIG. 6). This causes rear portion 106 to slide across ears 104 to be in contact with ear 104 adjacent body portion 54. At the same time, engaging portion 108 of push rod 90 slides through opening 72 as hook 112 slides through base **33*c* of U-shaped groove 33 to be positioned behind the remaining stud 39 coaxially with the associated bore 38. Remaining stud 39 is in a cooperative position with remaining clutch 47. Notch 119 acts as a locking means when it catches on opening 53 preventing return of keeper 116 to its original position and in turn preventing reuse of ear piercing assembly 20**.

The process described above is repeated for piercing the ear a second time. Accordingly, pressure is applied to shoulder 102 so that base 88 moves within housing 48 while ear 104 applies a force behind push rod 90 to push stud retaining sub-assembly 30 into contact with ear lobe 122. Push rod 90 is then further pushed into bore 88 moving hook 112 within leg **33*b* of U-shaped groove 33 displacing ribs 31 and driving stud pin 39*b* through ear lobe 122. After piercing, shoulder 102 is released so that spring 114 biases push rod assembly 50 in the direction of arrow A causing hook 112 to retract now empty stud retaining sub-assembly 30 back into stud retaining sub-assembly receiving portion 58. Assembly 20** is disposable and therefore the assembly is now thrown away preventing cross-contamination with a later user.

By constructing an ear piercing assembly having a push rod assembly with a pivotable hinge so that the push rod is displaceable from a first position behind a first stud coaxial with a retaining sub-assembly bore to a second position behind a second stud coaxial to a retaining sub-assembly bore, without touching the retaining sub-assembly, an ear piercing assembly which effectively eliminates handling of the retaining sub-assemblies after sterilization is provided. By utilizing a pivotable hinge and a push rod assembly in a housing which may be formed of a few integral molded pieces, the construction of the assembly is simplified reducing costs making the instrument disposable. Further, by designing an ear piercing assembly having a convex shoulder and a finger hole adjacent the saddle region an anchoring system for steadying the assembly within the palm of the user's hand is provided.

It will thus be seen that the objects set forth above, among those made apparent from the previous description, are efficiently obtained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language might be said to fall therebetween.

What is claimed is:

1. An ear piercing assembly comprising a first and second earring stud; stud retaining sub-assembly means for releaseably supporting both said earring studs; a first and second clutch; clutch retaining sub-assembly means for releaseably supporting both of said clutches; housing means for supporting said stud retaining sub-assembly means and said clutch retaining sub-assembly means therein; push rod assembly means disposed within said housing means for ejecting a stud from said stud retaining sub-assembly means; and displacement means for selectively moving said push rod assembly means between a first position for ejecting said first stud from said stud retaining means and a second position for ejecting said second stud from said stud retaining means.

2. The ear piercing assembly of claim 1, wherein said push rod assembly means includes a base, a push rod mounted on said base, and hinge means disposed between said push rod and said base for allowing said push rod to pivot between said first position and said second position relative to said base.

3. The ear piercing assembly of claim 2, wherein said hinge means includes a living hinge.

4. The ear piercing assembly of claim 2, wherein said housing means includes a stud retaining sub-assembly receiving portion, said stud retaining sub-assembly means being maintained within said stud retaining sub-assembly receiving portion and being slidable between a first position and a second position within said stud retaining sub-assembly receiving portion, and said push rod including retraction means for returning said stud retaining sub-assembly from said second position to said first position.

5. The ear piercing assembly of claim 4, wherein said stud retaining sub-assembly means is formed with a support wall and a casing extending from said support wall, a U-shaped groove being formed within said casing, and said retraction means including a hook extending from said push rod, said hook being disposed within said groove and cooperating with said support wall to return said stud retaining sub-assembly means to said first position when said push rod moves in a predetermined direction.

6. The ear piercing assembly of claim 5, wherein said casing is formed with ribs therein, said ribs releasably maintaining said stud in position prior to piercing.

7. The ear piercing assembly of claim 2, wherein said base extends from said housing means, said portion of said base extending from said housing means being formed as a convex shoulder.

8. The ear piercing assembly of claim 2, wherein said push rod includes an engaging portion for engaging said stud and a rear portion, said base being formed with a first ear and a second ear, said rear portion slidably contacting said first ear when said push rod is in said first position for ejecting said first stud and slidably contacting said second ear when said push rod is in said second position for ejecting said second stud.

9. The ear piercing of claim 8, wherein said displacement means includes a keeper mounted about said engaging portion of said push rod.

10. The ear piercing assembly of claim 9, further comprising push rod locking means for locking said push rod in said second position for ejecting said second stud.

11. The ear piercing assembly of claim 10, wherein said keeper extends through said housing means, forming a button, said locking means including a notch formed on said button.

12. The ear piercing assembly of claim 2, further comprising anchoring means for anchoring said ear piercing assembly within the palm of the user, said anchoring means including said housing means being formed with an opening therein adjacent said stud retaining sub-assembly means and said base being formed with a convex shoulder, said convex shoulder being disposed outside of said housing means whereby said ear piercing assembly is anchored within the palm of a user between said shoulder and said opening.

13. The ear piercing assembly of claim 2, wherein said base is slidably disposed within said housing means.

14. The ear piercing assembly of claim 1, wherein said housing means includes a stud retaining sub-assembly receiving portion, said stud retaining sub-assembly means being slidably retained within said stud retaining sub-assembly receiving portion to allow movement between a first position and a second position within said stud retaining sub-assembly receiving portion.

15. The ear piercing assembly of claim 14, wherein said push rod assembly means further comprises retraction means for returning said stud retaining sub-assembly means from said second position to said first position.

16. The ear piercing assembly of claim 1, further comprising anchoring means for anchoring said ear piercing assembly within a palm of the user.

17. The ear piercing assembly of claim 16, wherein said anchoring means includes said housing means being formed with a hole therein adjacent said stud retaining sub-assembly means adapted to receive the finger of a user.

18. An ear piercing assembly comprising a first and second earring stud; stud retaining sub-assembly means for releaseably supporting both said earring studs, said stud retaining sub-assembly means being formed with a support wall and a casing extending from said support wall, a U-shaped groove being formed within said retaining sub-assembly; a first and second clutch; clutch retaining sub-assembly means for releaseably supporting both of said clutches; housing means for supporting said stud retaining sub-assembly means and said clutch retaining sub-assembly means therein, said housing means being formed with an opening therein and including a stud retaining sub-assembly receiving portion, said stud retaining sub-assembly means being maintained within said stud retaining sub-assembly receiving portion and being slidable between a first position and a second position within said stud retaining sub-assembly receiving portion; push rod assembly means disposed within said housing means for ejecting a stud from said stud retaining sub-assembly means; displacement means for selectively moving said push rod assembly means between a first position for ejecting said first stud and a second position for ejecting said second stud; said push rod assembly means including a base, said base being formed with a convex shoulder, a push rod mounted on said base, and hinge means disposed between said plunger and said base for allowing said plunger to pivot between said first position and said second position relative to said base, said push rod including retraction means for returning said stud retaining sub-assembly from said second position to said first position, and said retraction means including a hook formed on said push rod, said hook being disposed within said groove and cooperating with said support wall to return said stud retaining sub-assembly means to said first position when said push rod moves in a predetermined direction, and said convex shoulder being disposed outside of said housing means whereby said ear piercing assembly is anchored within the palm of a user between said shoulder and said opening.

19. The ear piercing assembly of claim 18, wherein said displacement means includes a keeper mounted about said push rod, and push rod locking means for locking said push rod in said second position for ejecting said second stud.

* * * * *